US005110023A

United States Patent [19]

Colin

[11] Patent Number: 5,110,023

[45] Date of Patent: May 5, 1992

[54] CARRIER FOR POOL VACUUM HOSES

[75] Inventor: George M. Colin, Dana Point, Calif.

[73] Assignee: Odyssey Systems Ltd., San Clemente, Calif.

[21] Appl. No.: 699,307

[22] Filed: Apr. 18, 1991

[51] Int. Cl.[5] ..... A45C 13/30; A45F 3/14

[52] U.S. Cl. ..... 224/205; 224/250; 224/258

[58] Field of Search ..... 224/258, 202, 205, 206, 224/250, 191, 917; 294/150, 138, 164; 24/182

[56] References Cited

U.S. PATENT DOCUMENTS

| | | | |
|---|---|---|---|
| D. 304,977 | 12/1989 | Pappas | 224/205 |
| 571,689 | 11/1896 | Rozell | 24/182 |
| 1,411,175 | 3/1922 | Maguire | 294/150 |
| 1,490,066 | 4/1924 | Carr | 224/205 |
| 1,611,456 | 12/1926 | Keller | 294/150 |
| 2,679,937 | 6/1954 | Fulster | 224/250 |
| 2,812,123 | 11/1957 | Girton | 294/150 |
| 2,884,173 | 4/1959 | Campbell | 224/205 |
| 3,023,941 | 3/1962 | Foley | 224/205 |
| 3,920,166 | 11/1975 | Hogensen, Jr. | 224/205 |
| 4,531,661 | 7/1985 | Santy | 224/917 |

FOREIGN PATENT DOCUMENTS

| | | | |
|---|---|---|---|
| 177255 | 11/1961 | Sweden | 224/258 |

*Primary Examiner*—Henry J. Recla
*Assistant Examiner*—Keith Kupferschmid
*Attorney, Agent, or Firm*—W. Norman Roth

[57] ABSTRACT

An improved carrying strap for carrying a long hose such as a corrugated plastic pool vacuum hose has a shoulder loop of unvarying size and a variable size hose carrying loop which may be quickly cinched around multiple turns of a hose to be carried. The strap uses a single rigid connector having a pair of parallel bars around which the continuous strap is wrapped to form the loops.

5 Claims, 1 Drawing Sheet

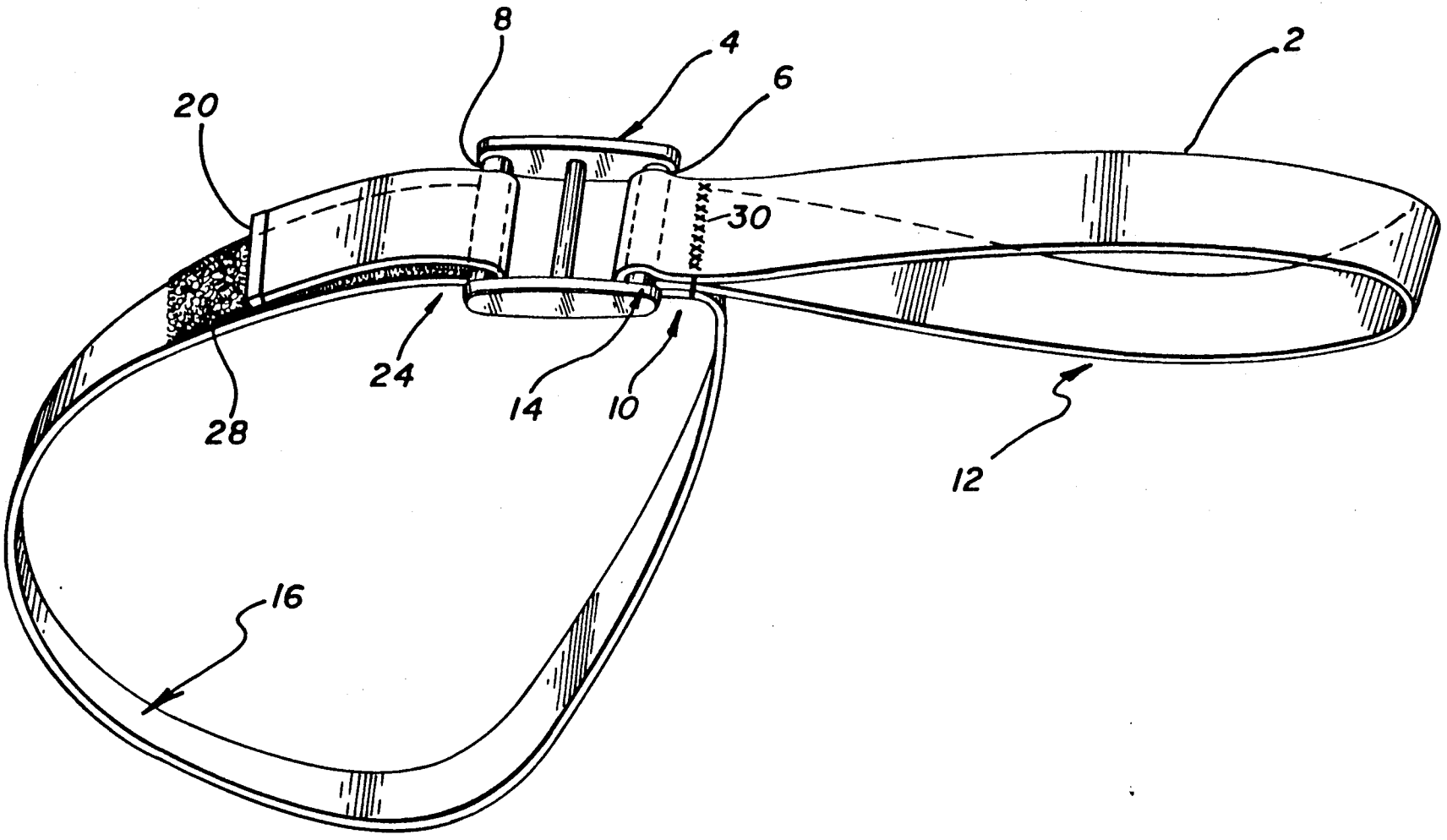
2
12
6
30
4
10
14
8
24
16
20
28

CARRIER FOR POOL VACUUM HOSES

BACKGROUND OF THE INVENTION AND PRIOR ART

Swimming pool maintenance requires frequent cleaning of debris which ordinarily rests on the bottom of the pool. To this end pool owners and maintenance personnel will occasionally vacuum the pool using a long corrugated plastic hose (about 30–50' in length) which is carried to the pool and attached to the powered poolside skimmer vacuum inlet to draw water and debris through the hose whereby it may be removed from the pool by the pool filter or traps. Vacuum hoses are typically quite light in weight for easy portability but are very unwieldy due to their excessive length and tendency to uncoil.

An economical carrier is required which is capable of being rapidly affixed around a coiled hose while the hose is resting on the ground or pool deck and which can easily be stored in one's pocket while not in use and without disturbing the ability of the carrier to function as intended.

SUMMARY OF THE INVENTION

The present invention accordingly provides a hose carrier comprising an elongated continuous flexible strap having a first and second ends and a rigid connector having a pair of spaced parallel bars, and strap being configured to form a shoulder loop, a hose carrying loop and a reverse cinching loop, said strap having a first bight extending around a first of said parallel bars of said connector between said hose loop and said shoulder loop, said shoulder loop having a first of said ends positioned adjacent said first bight, said bight having its two adjacent strap portions attached together with said first end in a common fastening, and said hose loop having a second bight extending around the second of said parallel bars of said connector, and said second end of said strap having means thereon for connecting said second end to said hose loop to form said second bight.

BRIEF DESCRIPTION OF THE DRAWING

The single drawing FIGURE is a perspective view of the hose carrier of the present invention.

DESCRIPTION OF THE PREFERRED EMBODIMENT

As seen in the drawing FIGURE, a continuous strap 2, preferably of water repellent material such as woven plastic, is configured around a rigid connector 4 having a pair of spaced parallel bars 6, 8. A first end 10 of the strap preferably is wrapped about 270° around a first 6 of the parallel bars of the connector 4, thence it is looped back upon itself to form a shoulder loop 12. The strap 2 then continues on over its first end 10 through the connector 4 forming a first bight 14 around the first connector bar 6 and adjacent the first end portion of the strap 2. Placement of the strap 2 such that a double thickness is wrapped over bar 6 allows the first end 10 of the strap to underlie and thus cushion wear on the first bight 14. The strap then continues to form a hose carrying loop 16 and has its second end 20 passed through and around the second, 8, of the spaced parallel bars of the rigid connector to form a second bight 24 in the same directional sense (counterclockwise as shown) as the first bight 14. The second or cinching end 20 of the strap 2 is provided with a strip of synthetic fastening material 28 such as Velcro (Trademark) which adheres when pressed together so that the second end 20 may be securely fastened to the strap 4 to cinch the hose loop 16 around a hose to be transported. The strip of fastening material 28 is adhesively bonded to the strap.

A permanent fastening 30 such as rivets or stitches affixes the adjacent parts of the strap 2 together in the location shown near the rigid fastener 4 to ensure that the preselected size of the shoulder loop 12 is not inadvertently varied while wrapping the hose loop 16 around a hose and tightening or removing the strap 2 from the hose. The particular configuration of the strap with the two bights 14, 24 being arranged around the rigid connector 4 has been selected to enable the hose to be quickly and easily bundled into the hoop loop 16 for transport without varying the length of the shoulder loop 12 through which an arm may be placed whereby the weight of the hose is substantially supported on one shoulder of the bearer. The carrier can be compacted and placed in the pocket while not in use.

Persons skilled in the art will readily appreciate that various modifications can be made from the preferred embodiment thus the scope of protection is intended to be defined only by the limitations of the appended claims.

I claim:

1. A hose carrier comprising an elongated continuous flexible strap having first and second ends and a rigid connector having a pair of spaced parallel bars, said strap being configured to form a shoulder loop, a hose carrying loop and a reverse cinching loop, said strap having a first bight extending around a first of said parallel bars of said connector between said hose loop and said shoulder loop, said shoulder loop having a first of said ends positioned adjacent said first bight, said bight having two adjacent strap portions attached together with said first end in a common fastening, whereby said shoulder loop is of a fixed size, and said hose loop having a second bight extending around the second of said parallel bars of said connector, and said second end of said strap having means thereon for connecting said second end to said hose loop at a selected position to form said cinching loop and determine the size of said hose carrying loop.

2. The carrier of claim 1, wherein said means for connecting comprises synthetic materials which adhere when pressed together.

3. The carrier of claim 2, wherein said common fastening is stitched.

4. The carrier of claim 3, wherein said first end of said strap extends around the first of said parallel bars of said connector to cushion and reduce wear on said first bight.

5. The carrier of claim 4, wherein said strap forms said second bight in the same direction sense in which it forms said first bight.

* * * * *